United States Patent [19]

Svensson

[11] 4,112,570

[45] Sep. 12, 1978

[54] APPARATUS FOR FORMING A JOINT FOR WIRE CLOTH

[75] Inventor: Einar Gustav-Vilhelm Svensson, Halmstad, Sweden

[73] Assignee: Wallbergs Fabriks AB, Halmstad, Sweden

[21] Appl. No.: 660,933

[22] Filed: Feb. 24, 1976

[30] Foreign Application Priority Data

Mar. 10, 1975 [SE] Sweden ..... 7502616

[51] Int. Cl.[2] ..... B23P 19/04

[52] U.S. Cl. ..... 29/241; 29/433; 24/31 B

[58] Field of Search ..... 29/433, 241, 238; 24/31 B

[56] References Cited

U.S. PATENT DOCUMENTS 3,280,435 10/1966 Nasworthy ..... 29/433 X 3,731,365 5/1973 Fryatt ..... 29/241

3,757,402 9/1973 Haythornthwaite et al. ..... 29/433 X

*Primary Examiner*—Charlie T. Moon

*Attorney, Agent, or Firm*—Holman & Stern

[57] ABSTRACT

A joint for wire cloth in which free loop portions at adjacent edges to be joined penetrate edges of an opposed wire cloth and are held open so that a locking wire penetrates through the loops; a method of joining the loops which includes holding loops of one wire open by means of a U-shaped bar so that the locking wire can be threaded into the bar and the loops, and as the locking wire is so threaded simultaneously withdrawing the U-shaped bar which has been holding the loops open; and apparatus for effecting the joining of loops of adjacent ends of wire cloth in which the loop forming seams are retained in a position so that a U-shaped bar can be introduced through one of the loops and holds them open for receiving free loops of a wire-screw so that a locking wire can be introduced through interdigitated loops of the wire cloths being joined.

4 Claims, 5 Drawing Figures

APPARATUS FOR FORMING A JOINT FOR WIRE CLOTH

FIELD OF THE INVENTION

This invention relates to a wire cloth joint comprising the joining of two wire cloth ends facing each other, each of which has a folded portion which formed by seams or the like, is joined to the wire cloth.

BACKGROUND OF THE INVENTION

The invention, further, relates to problems related to methods and a means for use at the making of such wire cloth joint in paper making apparatus.

The invention is particularly suitable to be used, in practice, for joining a drying wire cloth for a cylinder dryer in a paper-making machine; the wire cloth joint, from a wear point of view, is the weak point of the drying wire cloth and is exposed to chemical degradation and heat.

The present invention will simplify the joining procedure, increasing the strength and life of the joint and bringing about the joint in such a manner, that it does not give to disfiguring the paper being produced or at least substantially reduces disfigurement. This is achieved by the present invention so that the joints of the drying wire cloth are located at a very short distance relative to each other.

SUMMARY AND OBJECTS OF THE INVENTION

In a wire cloth joint of the kind referred to above, the object is achieved where a wire-screw is rigidly attached to one end of the wire cloth and extends along the entire wire cloth end and with a portion of its free loops projecting beyond the wire cloth end, the free loop portions are adapted to penetrate the edge of an opposed wire cloth end and into a space within the fold thereof, and from the longitudinal side of the wire cloth a locking wire penetrating all loops is inserted into the said fold.

A method according to the present invention relates to the joining of two wires, the ends of which each comprise a folded portion, which is joined to its respective wire cloth by seams or the like, and the end portion of one wire cloth is provided with an endless wire-screw attached to the wire cloth according to above, which screw has an oval cross-section and is so fastened in the end of the wire cloth so that a portion of each wire-screw loop lies exposed outside said end. The method is substantially characterized in that a passage is formed in the fold at the end of the opposed wire cloth by means of an inserted U-shaped bar, the open part of which faces toward the wire cloth end, and through the edge of the passage facing toward the opposed wire cloth end and the wire-screw loops are pressed for insertion into said U-shaped bar, whereafter a locking wire is threaded into said bar, and therewith also through the loops of the wire-screw, and simultaneously with the successive insertion of the wire said bar is pulled out.

A means for joining two wire cloths, the end of which each comprise a folded portion joined to its respective wire cloth by seams or the like, and the end portion of one wire cloth is provided with an endless wire-screw attached to the edge of said said portion, which screw extends along the entire wire cloth end and a portion of each wire-screw loop lies exposed outside of said end, is subatantially characterized in that it comprises guide means, which are active against the inner ends of the folded portion of the respective wire cloth end for pressing said exposed portions of the wire-screw into intermediate spaces between warp wire loops along the edge of the end portion of the other wire cloth, and a means for holding open said warp wire loops so as to render possible the insertion of a locking wire through said loops and through the pressed-in-wire-screw portions.

Previously known wire cloth joints comprise two wire screws engaging with and by a locking wire joined to each other.

According to the invention, only one wire screw is used, which is attached to one end of the wire cloth and intended at the joining by the aforesaid means to be inserted between the warp wire loops of the other end of the wire cloth which for this purpose are exposed. In order to form intermediate spaces between said loops, the weft wires at said end are removed. The wire screw is locked in the passage formed by the loops by the insertion of a locking wire or the like in the transverse direction of the wire cloth. In order to facilitate the insertion of the locking wire into the passage, the aforesaid U-shaped guide bar is used which is advanced over the joint simultaneously with the joining means, and the locking wire thereby follows with the bar.

DESCRIPTION OF THE DRAWING

The invention is described in greater detail in the following description, with reference to the accompanying drawing forming a part thereof, which show an exemplary embodiment according to the invention.

DESCRIPTION OF A PREFERRED EMBODIMENT

Figure 1:
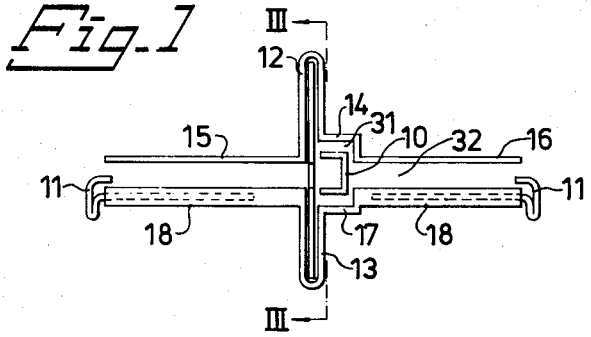
FIG. 1 is an end elevation of the joining means used in the invention.
Figure 3:
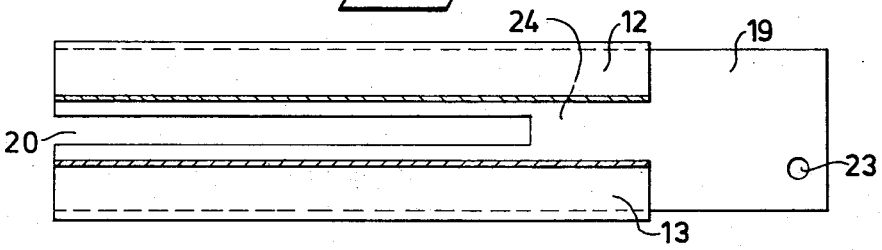
FIG. 3 is a longitudinal section taken on line III—III of FIG. 1.
Figure 4:
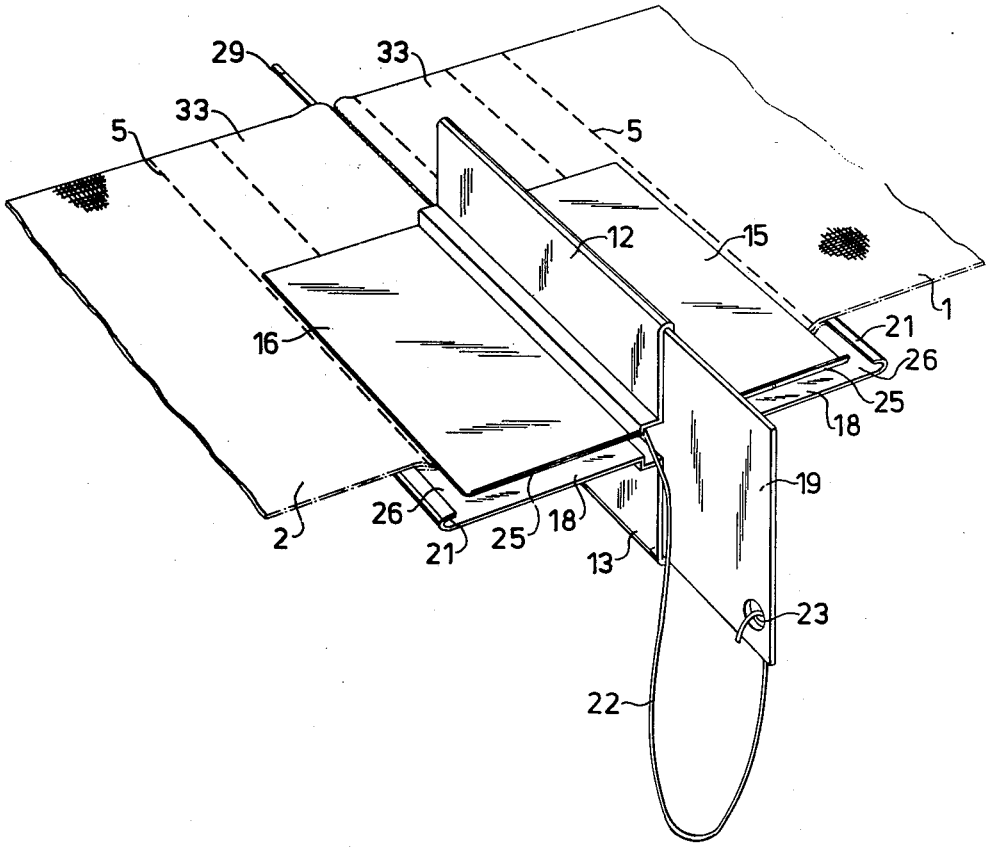
FIG. 4 is a perspective view of the joining means with wire cloth edge portions during forming of a joint with only a portion of the wire cloth being shown.
Figure 5:
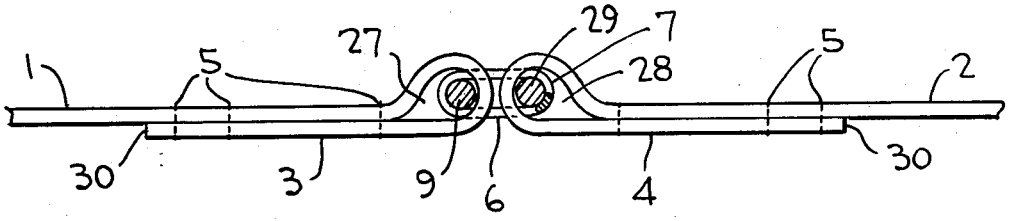
FIG. 5 is a section showing the final joint produced when the two edge portions of FIG. 2 are joined.

A joint forming means is shown is shown in FIGS. 1, 3 and 4 and comprises a central wall 24 provided with a laterally open slit 20 and an opposite freely projecting portion 19 (see FIG. 3). A lower metal panel has a folded edge 21 on each side comprising a bottom portion 18 on each side of the central wall 24. The lower metal panel includes a central downwardly projecting, U-shaped stiffening portion 13, into which the lower edge of the central wall 24 is inserted and in which it is secured, for example, by rivets (not shown). An upper metal panel, less wide than the lower metal panel, comprises two lateral portions 15 and 16, respectively, one each side of the central wall 24 and a stiffening portion 12 of inverted U-shape, which envelops the upper edge of the central wall 24 and is secured thereon, for example, by rivets (not shown). Between the longitudinal edges of the upper metal sheet and the folded-up edges 21 of the lower metal panel longitudinal slots 26 are formed on each side for receiving the wire cloth end 1 and 2, (FIG. 4). The front edges of the lateral metal panels 15, 16 are folded up at flange 25 (FIG. 4) in order to facilitate the insertion of the wire cloth 1, 2 into the joint forming means.

Figure 2:
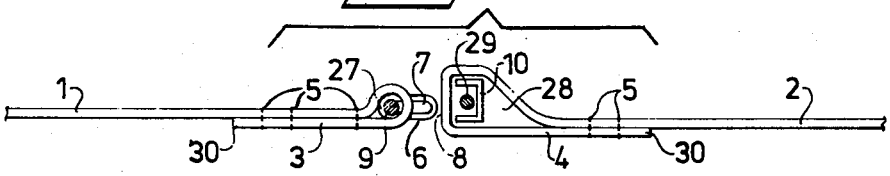
FIG. 2 shows two edge portions of a wire cloth to be joined.

The wire cloth ends, as appears from FIG. 2, are doubled over their ends 1, 2 so that folded portions 3 and, respectively, 4 are formed. These folded portions are sewn onto opposed wire cloth portions by seams 5. At the outer edge of the left-hand wire cloth end 1, warp wire loops 27 are formed by means of folding and removing a number of weft wires. In said warp wire loops 27 is fastened an endless wire screw 6 by means of a locking wire 9 extending through said wire screw and loops. The wire screw 6 has an oval loop shape, and a portion 7 of each loop lies freely outside the wire cloth end. The right-hand wire cloth end 2 has warp wire loops 28, which are obtained by the removal of a number of weft wires at this free end. In FIG. 2, a U-shaped bar 10, associated with the joining means, is shown inserted into the loops 28, thereby holding open the outer edge 8 of the wire cloth end 2 so that the portion 7 of the wire screw 6 can be inserted between the respective loops 28. A locking wire 29 is shown inserted into the bar 10.

Distinguished from the embodiment in FIG. 4, at the view thorugh the joining means shown in FIG. 1, the guide and contact edges 11 for the inner ends 30 of the folded portions 3, 4 of the wire cloth ends, corresponding to the edges 21 in FIG. 4, are movably adjustable to adapt to different folding lengths of these portions. The right-hand bottom metal panel portion 18 is connected through a stepped portion 17 to the stiffening portion 13, and the right-hand upper lateral metal panel 16 is connected via a corresponding portion 14 to the stiffening portion 12. The portions 15 and 18 to the left are connected without such stepped portion. Between the stepped portions 14 and 17, a passage 31 is formed, the bottom 32 of which is partially open to receive the edge of the wire cloth end 2 and the bar 10 inserted therein.

For joining the two wire cloth ends 1 and 2 (see FIG. 4) by using the joining means according to the invention, the wire cloth ends with their edges 30 flush are inserted each into one of the openings 15, 18 between the metal panels 16 and 18, which openings are located on opposite sides of the central wall 24. The outer edge 8 of the cloth end 2 is guided in the passage 31 (FIG. 1), into which edge the U-shaped bar 10 is inserted so that the loops 28 are widened. The locking wire 29 is inserted into the series of the widened loop 28. A bow-shaped steel wire 22 is hooked with one end into a hole 23 in the portion 19 of the joining means, and its other end hooked into a hole in the bar 10 (not shown) serves as a handle for pulling the joining means across the width of the wire cloth joint. While this takes place, the free loop portions 7 of the wire screw 6 penetrate successively between subsequent loops 28, and these portions 7 are interlocked with the warp wire loops 28 by the locking wire 29 successively being fed in. The wire cloth ends 1 and 2, during the movement of the joining means, are guided with their edges 30 against the respective folded edges 21 of the bottom metal sheet 18 of the joining means. Said edges 21 may slightly converge rearward, seen from the forward portion 19, in order to successively increasingly press the wire cloth portions 1 and 2 against each other.

I claim:

1. Apparatus for joining two wire cloth ends to form a wire cloth joint, the ends each having a folded portion joined to its respective wire cloth by seams or the like, and the folded portion of one wire cloth having attached to its edge an endless wire screw extending along the wire cloth end and with said screw having loops lying freely outside the end, said apparatus comprising guide means for acting against the folded portions of the respective wire cloth ends for pressing free portions of the wire screw into spaces between warp wire loops along the edge of the end portion of the other wire cloth, said guide means comprising first upper and lower guide members spaced apart to accommodate said one wire cloth end therebetween and second upper and lower guide members spaced apart to accommodate said other wire cloth end therebetween, means interconnecting said first guide members with said second guide members and defining a passage for accommodating said warp wire loops in an opened-out condition, said passage having a depth greater than the spacing between the respective upper and lower guide members, and a substantially U-shaped bar longitudinally slidable into said passage for holding open said warp wire loops to maintain them in said opened-out condition for the insertion of a locking wire through said loops and through the pressed-in portions of the wire screw.

2. Apparatus according to claim 1, in which the guide members have outer converging guide bars.

3. Apparatus according to claim 2 in which the converging bars (11) are adjustable for conforming to folded portions of different lengths.

4. Apparatus according to claim 1 wherein said means interconnecting said first guide members with said second guide members includes a central wall, the central wall along a greater part of its length defining a slit having a width corresponding substantially to the width of the free portion of the wire screw loops.

* * * * *